US006276157B1

(12) United States Patent
Moraes

(10) Patent No.: US 6,276,157 B1
(45) Date of Patent: Aug. 21, 2001

(54) AIR EXHAUST ACTUATOR FOR AN AIR CONDITIONER

(75) Inventor: Luciano da Luz Moraes, Canoas (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/554,057

(22) PCT Filed: Sep. 16, 1998

(86) PCT No.: PCT/BR98/00072

§ 371 Date: May 9, 2000

§ 102(e) Date: May 9, 2000

(87) PCT Pub. No.: WO00/16012

PCT Pub. Date: Mar. 23, 2000

(51) Int. Cl.[7] ..... F25D 23/12
(52) U.S. Cl. ..... 62/262; 62/298; 62/427
(58) Field of Search ..... 62/262, 298, 427

(56) References Cited

U.S. PATENT DOCUMENTS

| | | | | |
|---|---|---|---|---|
| 3,643,461 | * | 2/1972 | Jacobs | 62/180 |
| 3,792,593 | * | 2/1974 | Loos et al. | 62/262 |
| 3,841,110 | * | 10/1974 | Schuster et al. | 62/427 |
| 4,111,001 | * | 9/1978 | Loos | 62/427 |
| 4,171,624 | * | 10/1979 | Meckler et al. | 62/271 |
| 4,553,405 | * | 11/1985 | Napelitano et al. | 62/262 |
| 5,010,742 | * | 4/1991 | Bolton et al. | 62/262 |
| 5,295,531 | * | 3/1994 | Tsunekawa et al. | 165/48.1 |
| 5,415,011 | * | 5/1995 | Gilmore et al. | 62/262 |
| 5,927,096 | * | 7/1999 | Piccione | 62/298 |

FOREIGN PATENT DOCUMENTS

4039164 * 6/1991 (DE) .
2170589 * 8/1986 (GB) .

* cited by examiner

*Primary Examiner*—William Doerrler
*Assistant Examiner*—Mark S. Shulman

(57) ABSTRACT

A room air conditioner of the type having a partition, which divides the indoor and outdoor sections of the air conditioning unit. The partition has an exhaust opening for exhausting room air into the outdoor section. An improved exhaust and control arrangement includes a scroll structure mounted in the indoor section for directing conditioned air into the space to be cooled. The scroll structure has a rear wall in confronting relation with the partition and has an exhaust opening therein in fluid communication with the indoor section side of the exhaust opening in the partition. Support structure is provided in the indoor section located laterally of and forwardly of the exhaust opening in the partition. The partition is provided with a second opening therethrough adjacent the support structure. A one-piece exhaust actuation device includes an elongated actuating arm. The arm has a first end extending forwardly of the support structure, an intermediate section extending in close proximity to the support structure and through the second opening into the outdoor section. A second end of the actuation device has a curved section configured to extend into the outdoor section in a first direction and to substantially reverse direction with the end of the curved section adjacent to the outdoor section side of the exhaust opening in the partition. The end of the curved section carries a door thereupon which is configured to block air flow through the exhaust opening in the partition when it is in confronting relation therewith. Means are provided on the support structure for pivotally supporting the intermediate section of the actuating arm at a position such that lateral movement of the first end of the arm will result in movement of the door selectively between a position in confronting relation with the exhaust opening and a position allowing free exhaust flow through the exhaust opening.

3 Claims, 9 Drawing Sheets

AIR EXHAUST ACTUATOR FOR AN AIR CONDITIONER

TECHNICAL FIELD

This invention relates to air conditioning units which are adapted to exhaust unwanted air as well as to provide conditioned air to a room being served by the unit. More specifically, the present invention relates to apparatus for moving a door covering an exhaust port in a self contained air conditioner having the foregoing capability.

BACKGROUND ART

Air conditioning units which are commonly used for residential and similar application generally are contained within a single casing. This casing is usually divided by a partition into an evaporator section and a condenser section, each section having its own fan to circulate air therein. The air conditioning unit is normally mounted with the evaporator section communicating with the room air to be conditioned and the condenser section communicating with external air such as outside air. Refrigerant flows through the self contained refrigerant circuit removing heat from the room air and discharging heat to the outside air.

In addition to the capability of the air conditioning unit to provide temperature controlled air to the room, it is desirable for the unit to have means for exhausting unwanted room air from the room to the outside. This is accomplished by the location of a port in the partition separating the condenser section from the evaporator section. A part of the room air enters the evaporator section of the unit and is forced by the evaporator and condenser fans through the port into the condenser section communicating with outside air.

Since the port must be selectively open when the unit is in the exhaust mode of operation, that mode in which part of the unwanted room air is being exhausted, and closed when the unit is in the separate mode of operation to condition the room air, a door is provided to cover the port and a control mechanism is necessary to maintain the door in the appropriate position.

Previous door control mechanisms, while effective, have been relatively complex, requiring numerous parts and considerable skill and effort to assemble the parts. Moreover, prior mechanisms have been awkward to operate and have required the exertion of considerable force to change door positions. Furthermore, mechanisms of the preceding type have tended to make access to the interior of the unit for service more difficult.

DISCLOSURE OF THE INVENTION

A room air conditioner of the type having a partition, which divides the indoor and outdoor sections of the air conditioning unit. The partition has an exhaust opening for exhausting room air into the outdoor section. An improved exhaust and control arrangement includes a scroll structure mounted in the indoor section for directing conditioned air into the space to be cooled. The scroll structure has a rear wall in confronting relation with the partition and has an exhaust opening therein in fluid communication with the indoor section side of the exhaust opening in the partition. Support structure is provided in the indoor section located laterally of and forwardly of the exhaust opening in the partition. The partition is provided with a second opening therethrough adjacent the support structure. A one-piece exhaust actuation device includes an elongated actuating arm. The arm has a first end extending forwardly of the support structure, an intermediate section extending in close proximity to the support structure and through the second opening into the outdoor section. A second end of the actuation device has a curved section configured to extend into the outdoor section in a first direction and to substantially reverse direction with the end of the curved section being adjacent to the outdoor section side of the exhaust opening in the partition. The end of the curved section carries a door thereupon which is configured to block air flow through the exhaust opening in the partition when it is in confronting relation therewith. Means are provided on the support structure for pivotally supporting the intermediate section of the actuating arm at a position such that lateral movement of the first end of the arm will result in movement of the door selectively between a position in confronting relation with the exhaust opening and a position allowing free exhaust flow through the exhaust opening.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
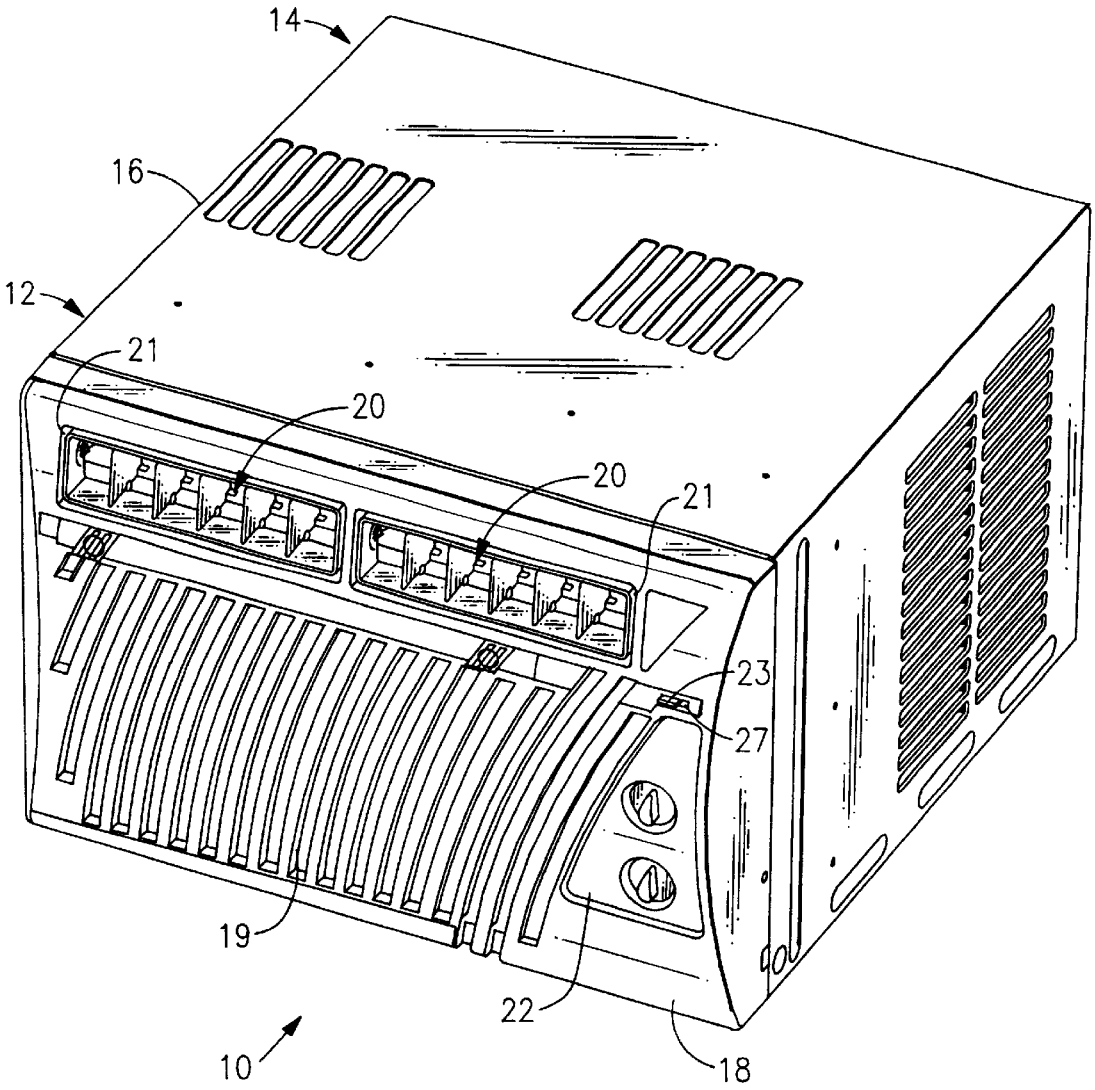
FIG. 1 is a perspective view of a room air conditioner, which embodies the features of this invention.
Figure 4:
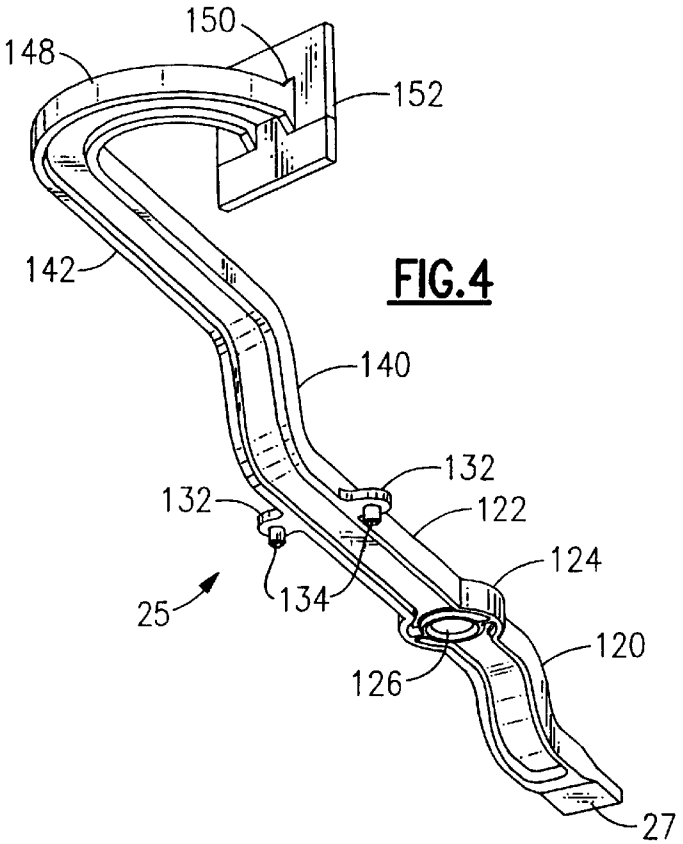
FIG. 4 is a front perspective view of the lower side of the air exhaust actuator, according to the present invention.
Figure 2:
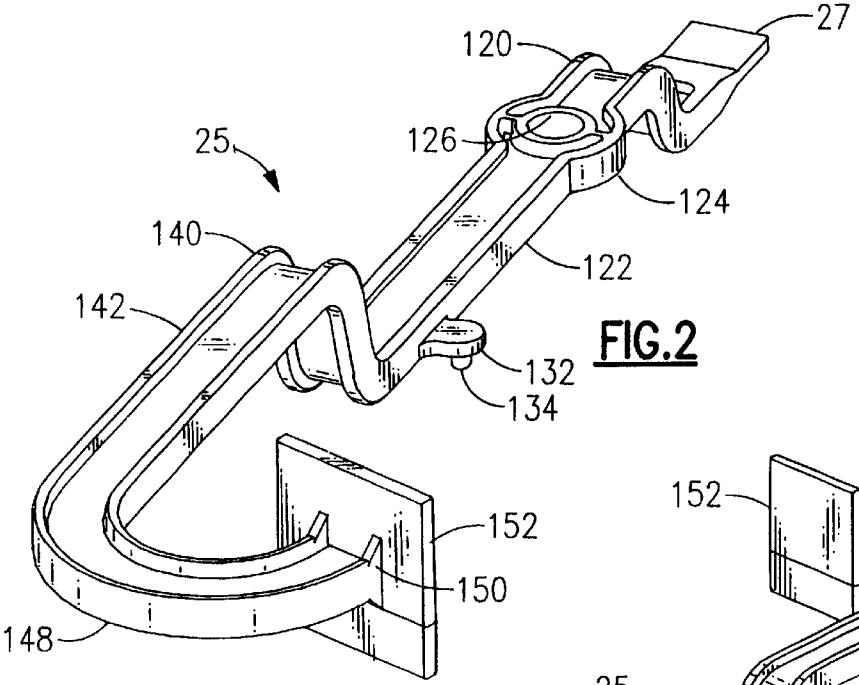
FIG. 2 is a rear perspective view of the air exhaust actuator, according to the present invention.
Figure 3:
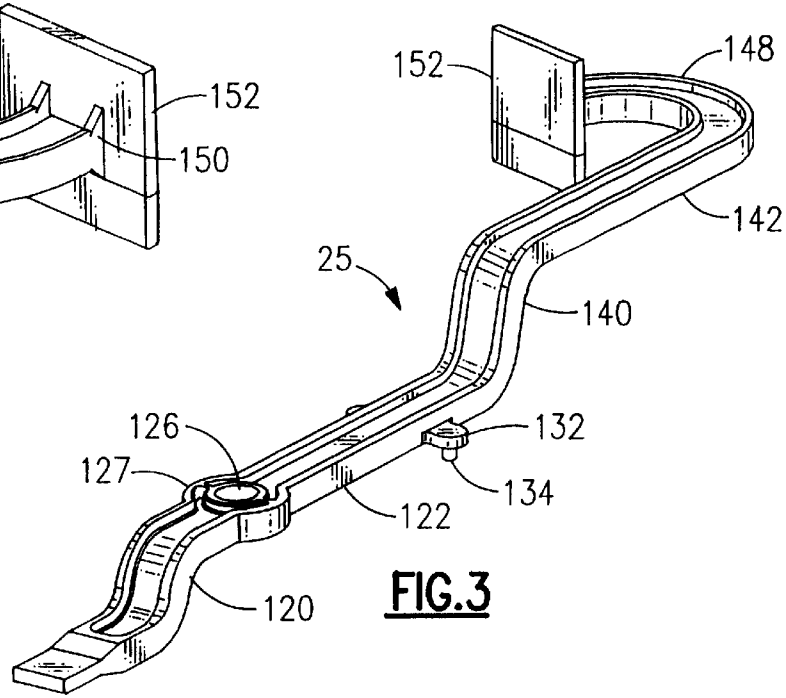
FIG. 3 is a front perspective view of the upper side of the air exhaust actuator, according to the present invention.

FIG. 1 illustrates a room air conditioner unit 10, which includes, generally, an indoor section 12 and outdoor section 14. The room air conditioner is enclosed in a substantially rectangular housing 16 and is adapted to be positioned in a rectangular opening in an exterior wall or in a window in a room where cooling is desired, with the indoor section 12 facing into the room, as is conventional. The indoor section 12 includes an indoor grille section 18, which includes inlet louvers 19 and a pair of air discharge assemblies 20, each mounted in an air discharge opening 21. The front grille 18 also includes a control panel 22 and directly overlying the control panel 22 a small rectangular opening 23 through which extends the actuating end 27 of an air exhaust actuator 25, which will be described in detail hereinbelow.

Figure 5:
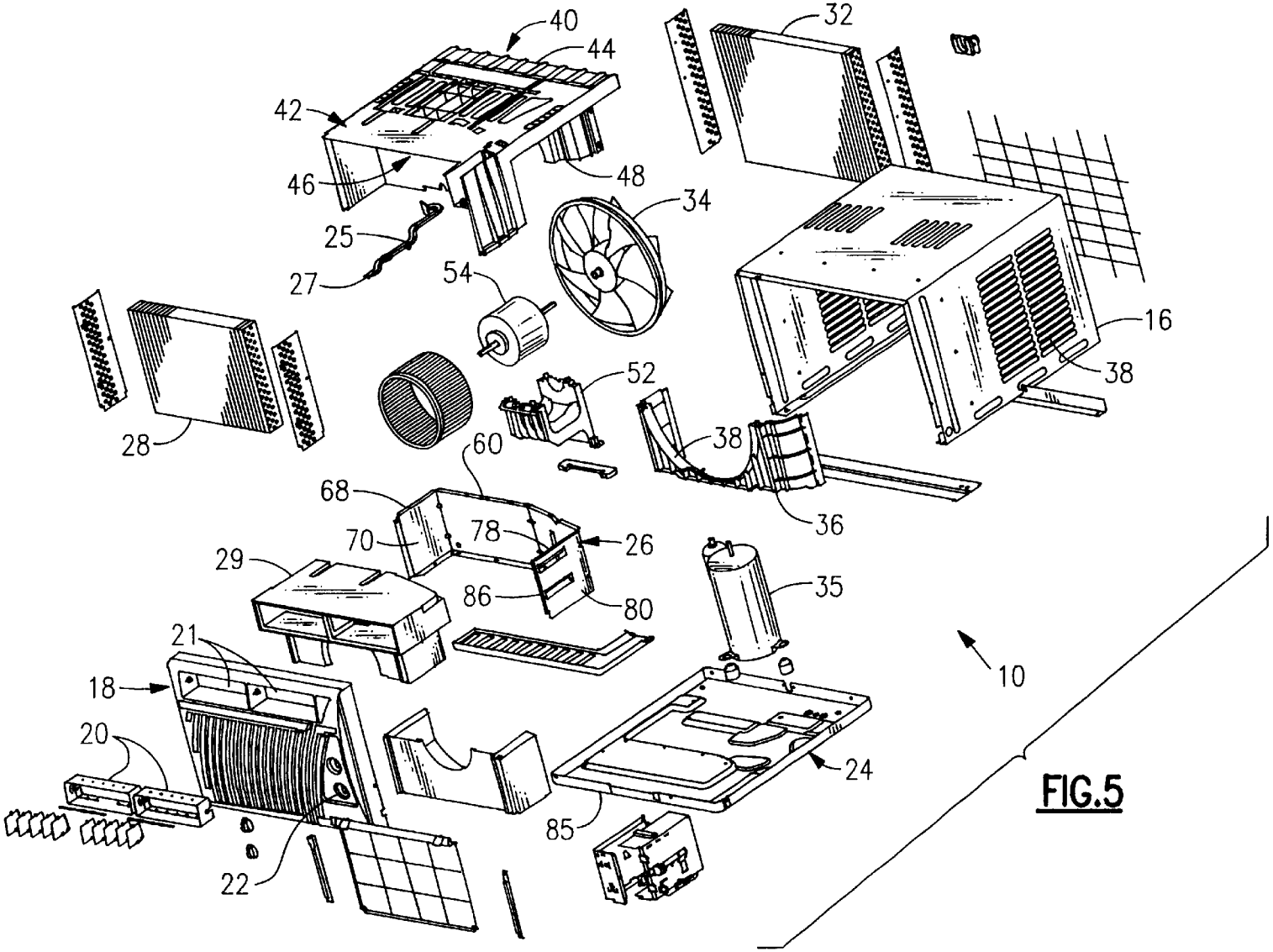
FIG. 5 is an exploded perspective view of the air conditioner illustrated in FIG. 1.
Figure 6:
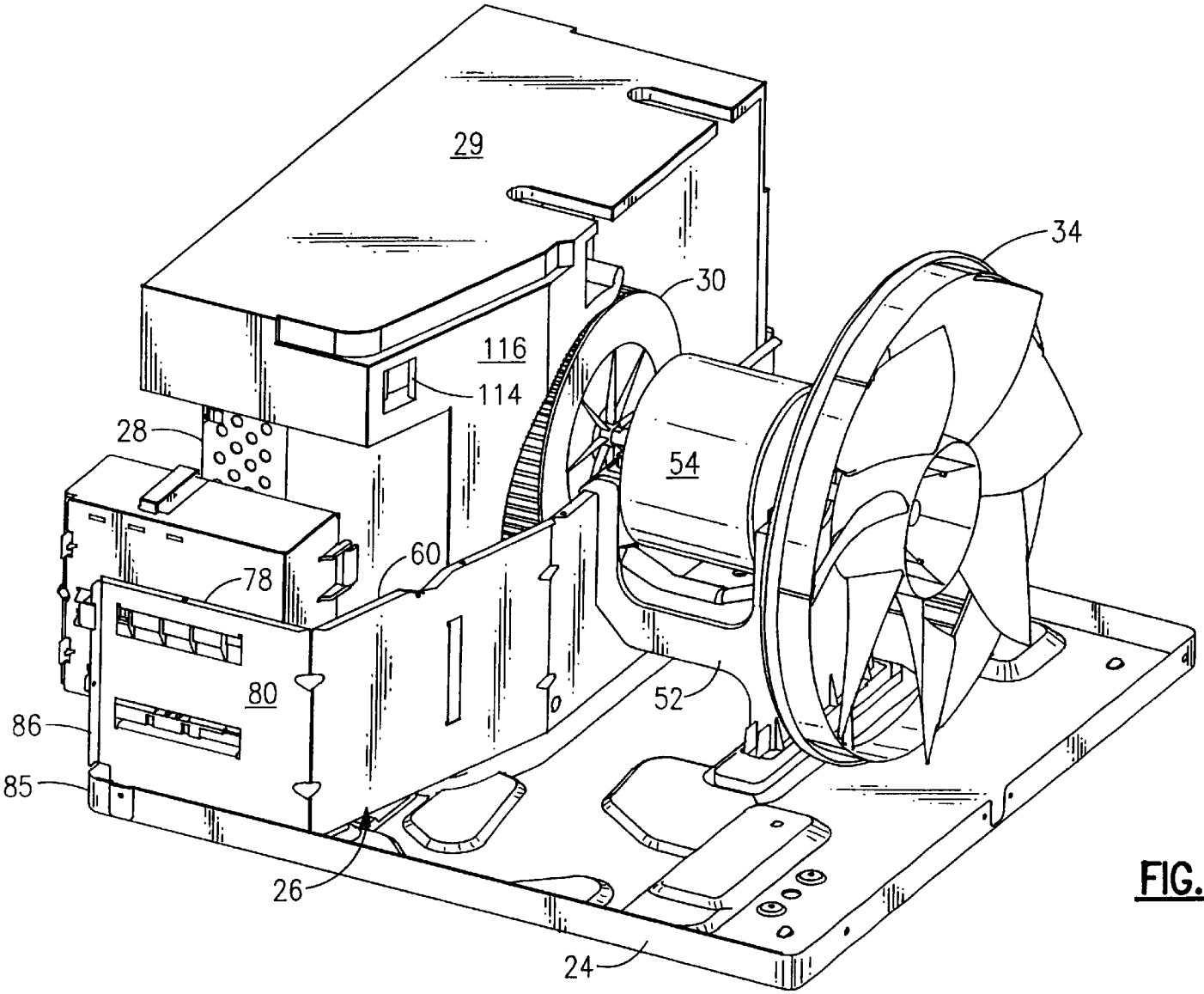
FIG. 6 is a rear perspective view of the air conditioner of FIG. 1 with the housing and a number of the internal components removed therefrom.
Figure 7:
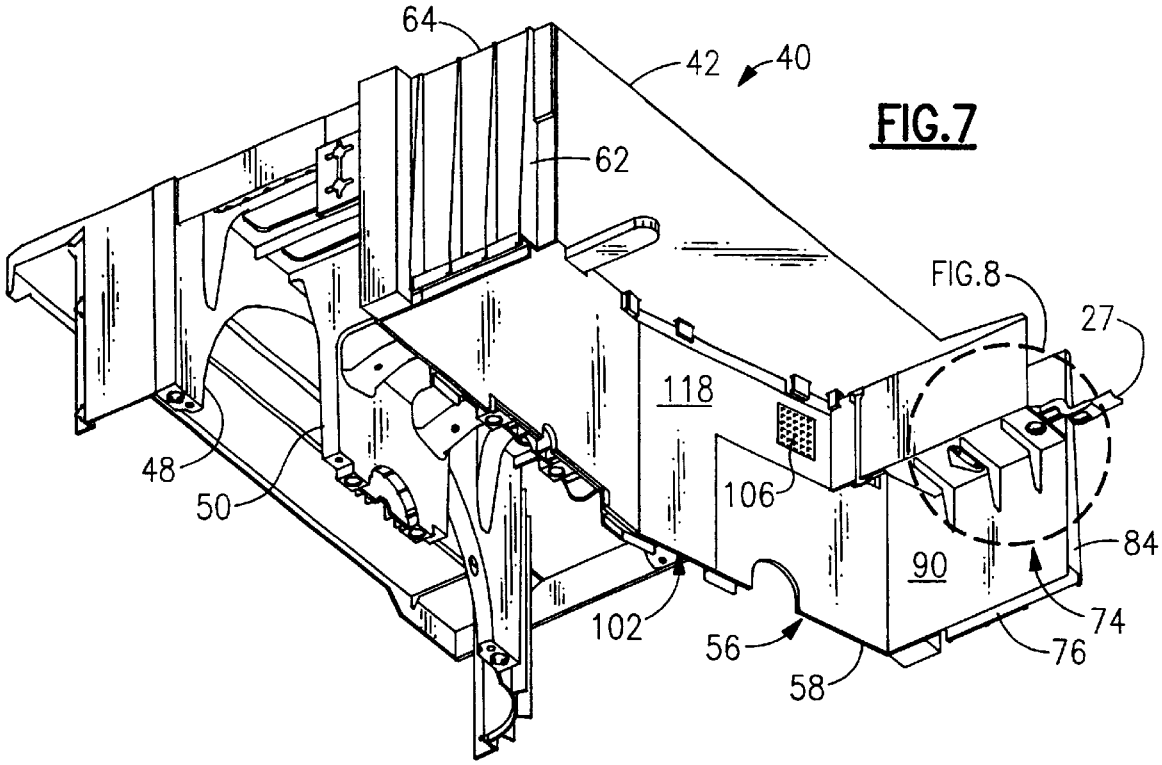
FIG. 7 is a perspective view of a large internal molded component of the air conditioner of FIG. 1 as viewed from the lower side thereof illustrating details of the present invention.
Figure 8:
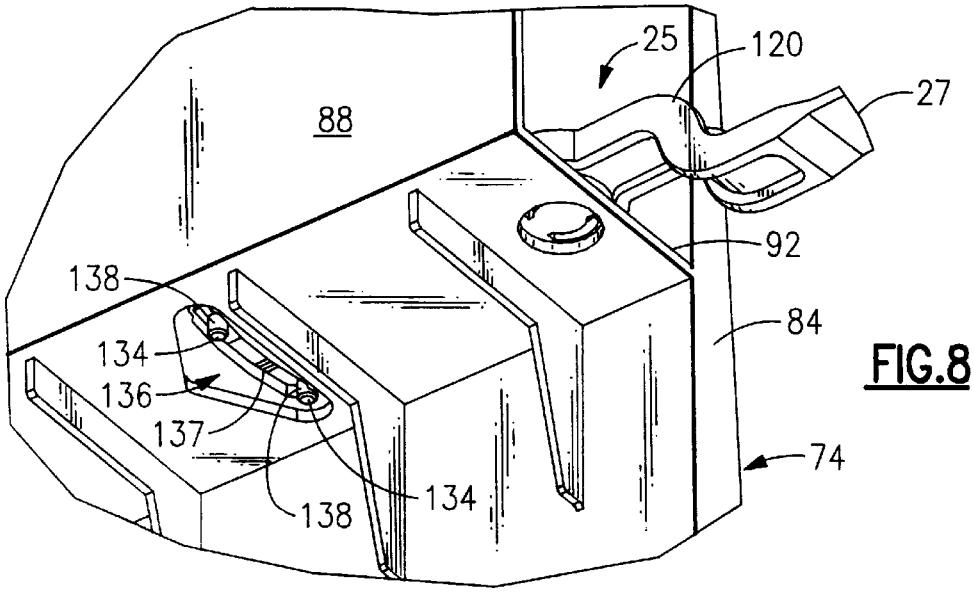
FIG. 8 is an enlarged view of the region designated FIG. 8 in FIG. 1.
Figure 9:
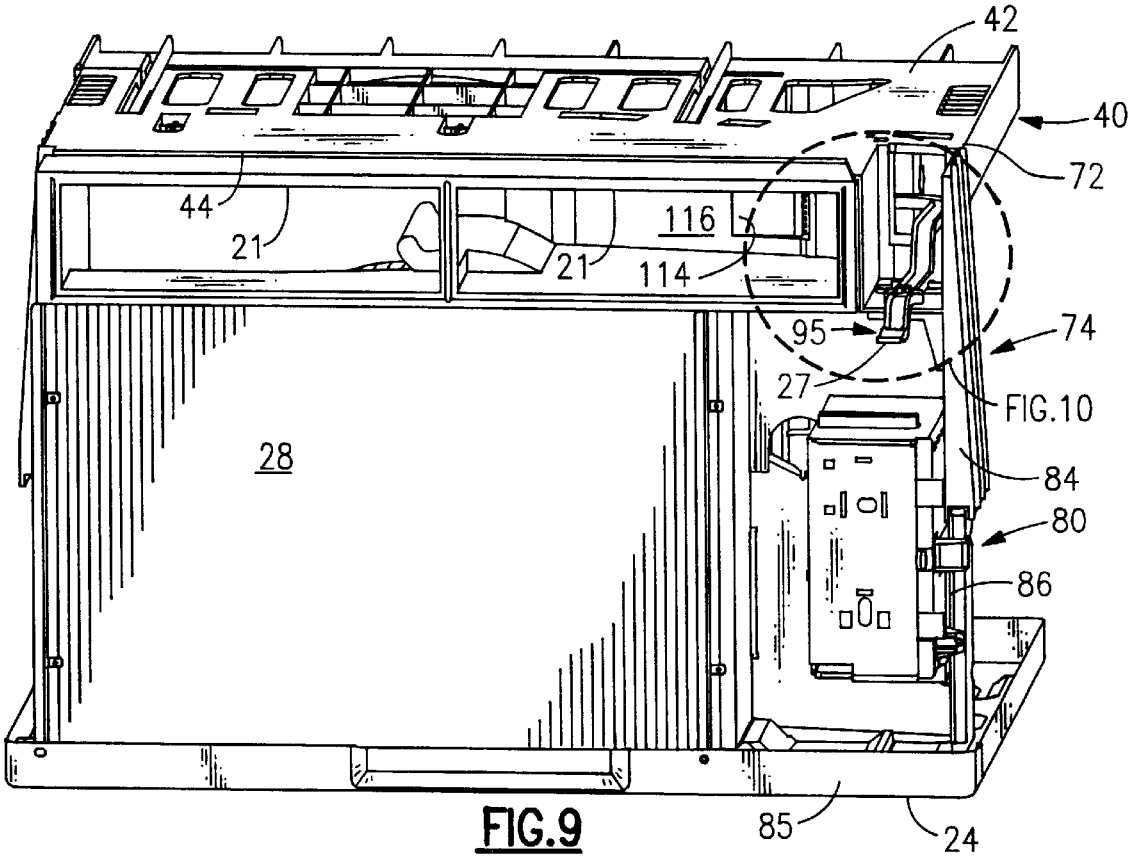
FIG. 9 is a front perspective view of the air conditioning unit of FIG. 9 with the housing and front grille removed therefrom.

Looking now at FIGS. 5, 6 and 9, the components of both the indoor section 12 and the outdoor section 14 are supported in a rectangular basepan 24. The indoor and outdoor sections are separated in part by a vertically extending metal partition 26, which extends from the basepan approximately one-half of the vertical distance of the air conditioning unit. The indoor section comprises basically an evaporator coil 28 vertically disposed at the front end thereof, an evaporator or indoor fan 30 located behind the evaporator coil 28, and an air directing scroll 29. The outdoor section 14 includes a condenser coil 32 vertically disposed adjacent the back end thereof, a condenser fan 34 located within the outdoor section adjacent the condenser coil, and a condenser fan shroud defined in part by lower section thereof 36. The unit's compressor 35 is also located in the outdoor section 14. The condenser coil 32 is fluidly interconnected with the compressor 35 and the evaporator 28 in a conventional manner to provide, in combination with fans, cooling to the room in which the unit is installed.

During operation, air from the space to be conditioned is drawn by action of the evaporator fan 30 through the inlet louvers 19 and is directed through the evaporator coil 28 where the air is cooled. The cooled air is then directed by the scroll 29 back into the room to be cooled through the air discharge openings/air discharge assemblies 21/20. At the same time, ambient air is drawn through inlets 38 in the outside section of the housing 16 and through a fan orifice 39 defined by the condenser shroud, by operation of the condenser fan 34, and is directed through the condenser coil 32 before exiting from the back side of the unit.

The air conditioning unit 10 is different from the construction of other window air conditioner units in that it includes a large one-piece molded component 40, which overlies both the indoor and outdoor sections 12 and 14 of the air conditioning unit and serves a number of support, positioning, dividing and other structural requirements of the air conditioning unit. This component and its relation to the overall structure of the air conditioning unit forms the subject matter of another patent application filed on the same date as the present application and, accordingly, will not be described in detail herein except as it relates to the air exhaust actuator of the present invention. It will, however, facilitate understanding of the invention to briefly describe the component, its structure and how it interacts with other components of the air conditioning system.

The large component comprises a substantially planar upper surface 42 having a rear horizontal extension 44, which is adapted to overly the condenser coil 32 and a front section 46, which overlies the scroll 29 of the indoor section. Extending downwardly adjacent the back section 44 is a downwardly extending section 48, which defines the upper section of the condenser fan shroud. Another downwardly extending structure 50 cooperates with a motor mount structure 52 to support an electric motor 54, which is adapted to drive both the evaporator fan 30 and the condenser fan 34.

Extending downwardly from the upper surface 42 of the component 40 and forwardly of the motor mounting section 50 is a vertically extending wall 56, which defines a lower edge 58. The edge 58 is configured to engage the upper edge 60 of the metal partition 26 so that the upper and lower sections together define the partition between the indoor and outdoor sections. A left-hand side wall 62 extends downwardly from the front left edge 64 of the upper surface 42 forwardly of the partition wall 56. The left wall 62 has a lower edge 66 which engages an upper edge 68 of a left side wall 70 of the metal partition section 26.

Figure 10:
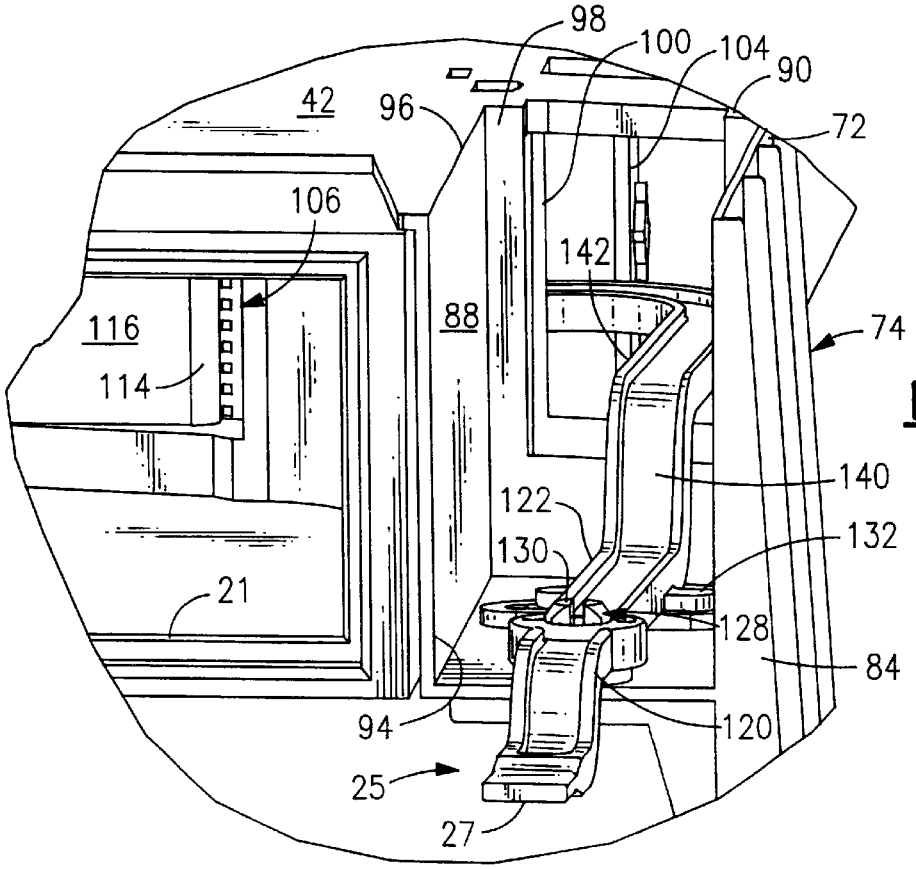
FIG. 10 is an enlarged view of the region designated as FIG. 10 in FIG. 9.

Extending downwardly from the right front edge 72 of the upper surface 40 is a right side wall 74. The side wall 74 defines a lower edge 76, which is configured to sealingly engage an upper edge 78 of a right-hand side wall portion 80 of the lower metal partition section 26. Both of the side walls 74 and 80 extend forwardly within the indoor section such that front edges 84 and 86 thereof, respectively, lie in a common plane with the front edge 85 of the basepan 24. As best seen in FIG. 10, a second inner side wall 88 extends downwardly from the upper surface 42 in confronting parallel relationship with the inside surface 90 of the upper portion of the right side wall 74. Extending between the outer right side wall 74 and the inner side wall 88 is a horizontal surface 92 which, as will be seen, serves to support the air exhaust actuator 25. The side wall 74, the side wall 88 and the horizontal support surface 92 together define a substantially rectangular space having an open front 94, an open top 96 and a back wall 98 which has a rectangular opening 100 formed therein.

Figure 11:
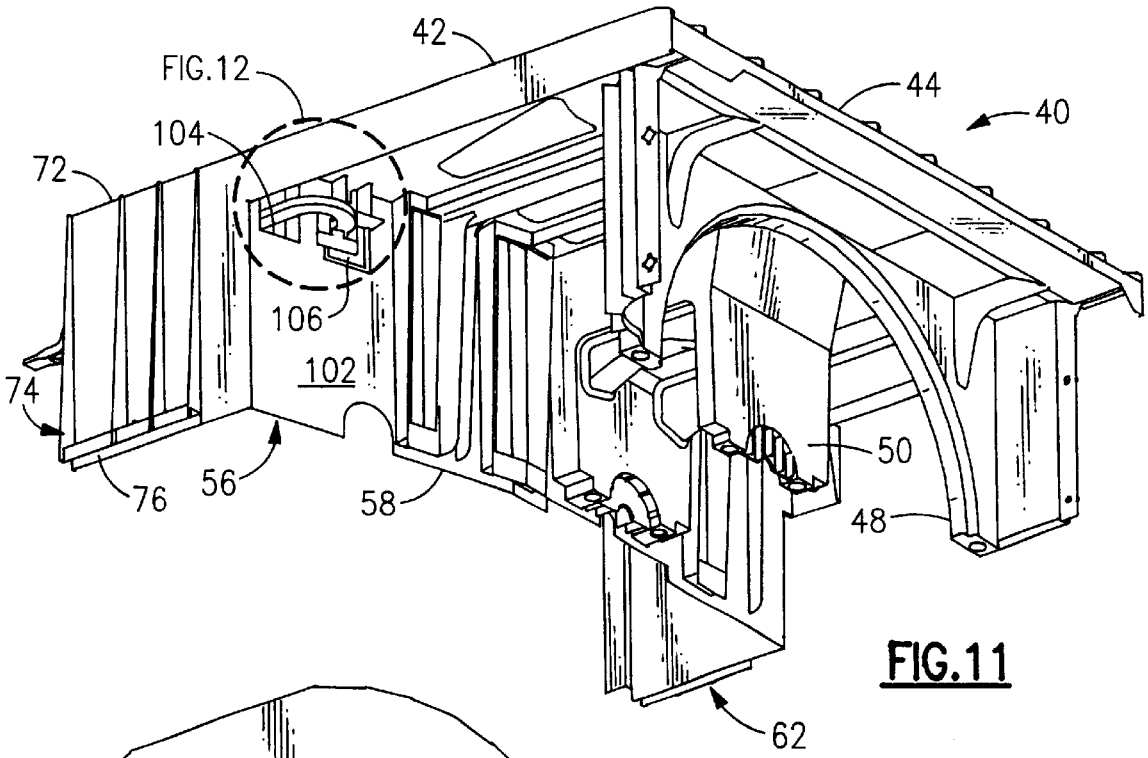
FIG. 11 is a perspective view of the large molded component illustrated in FIG. 7 from the rear thereof.
Figure 12:
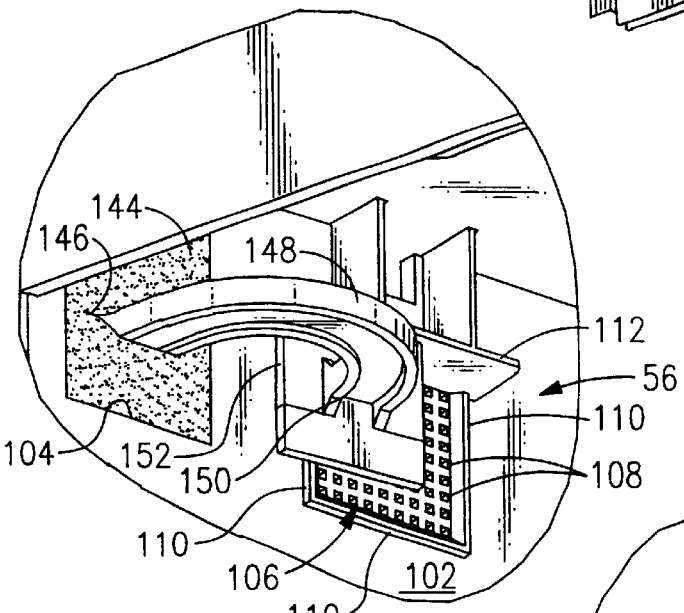
FIG. 12 is an enlarged view showing the region identified as FIG. 12 in FIG. 11 with the door open.

The back wall 98 and the opening 100 are spaced forwardly from a substantially planar section 102 formed on the right side of the partition wall 56, as best seen in FIG. 11. The wall 102 includes a rectangular opening 104 spaced rearwardly from and of substantially the same dimensions as the opening 100. The wall section 102 also has an air exhaust opening 106 formed therein at a location to the left of the opening 104, as viewed in FIGS. 9 and 10 (to the right thereof, as viewed in FIGS. 11, 12 and 12A). As is best seen in the detail of FIG. 12, the exhaust opening comprises a plurality of perforations 108 extending through the wall thus communicating the outdoor side section of the partition with the indoor section side of the partition. The opening 106 is substantially square shaped and has a rearwardly extending perimeter frame therearound defined by left, right and lower rearwardly extending elements 110 and a horizontally extending wall 112 forming the top thereof Looking now at FIGS. 6, 9 and 10, the evaporator scroll 29 is formed from a molded foamed plastic material and is provided with a rectangularly shaped air exhaust opening 114 formed in the rear wall 116 thereof As is best seen in FIGS. 9 and 10, the opening 114 is located in the interior of the scroll rearwardly of one of the air discharge openings 21. Also, as best seen in FIGS. 9 and 10, when the large molded component 40 is installed in the air conditioner, the exhaust opening 114 in the scroll and the rear wall 116 of the scroll is in confronting relationship with the indoor side 118 of the planar wall section 102, with the exhaust opening 114 in confronting fluid flow relationship with the exhaust opening 106 in the wall 102.

The air exhaust actuator 25. as indicated above. is a one-piece component having an outer end 27 for operating the actuator. From the outer end 27, the actuator extends through a first step section 120 to an elongated intermediate section 122. The front end of the intermediate section includes an enlarged section 124 having a through opening 126 formed therein. The opening 126 is adapted to receive therein a pivot pin 128, which is formed in the front section of the horizontal support surface 92. The pin 128 is molded into the support section and has a split configuration defining an enlarged head 130. The enlarged head is larger in diameter than the opening 126 and the split configuration of the pin allows the two sections forming the enlarged head to deflect toward one another to allow passage through the opening 126 with the two sections of the split head returning to their original position after passage through the opening to thereby mount the actuator 25 for pivotal movement about the pivot pin 128.

The intermediate section 122 also has formed therein, at a location spaced rearwardly from the opening 126, a pair of laterally extending protrusions 132, each of which is provided with a positioning pin 134 extending downwardly therefrom. Formed in the horizontal support surface 92 underlying the lateral protrusions 132 is a laterally extending arcuate slot 136. The slot has a central large dimension intermediate section 137, which receives both of the positioning pins 134 for free lateral translation of the pins therethrough as the actuating arm 25 is pivoted about the pivot pin 128. The slot has, at its left and right-hand ends thereof, arcuate reduced dimension sections 138, which are configured to receive in snap-fit relationship the positioning pin 134 associated therewith when said pin is caused to move into engagement therewith by pivotal movement of the actuator 25.

Figure 13:
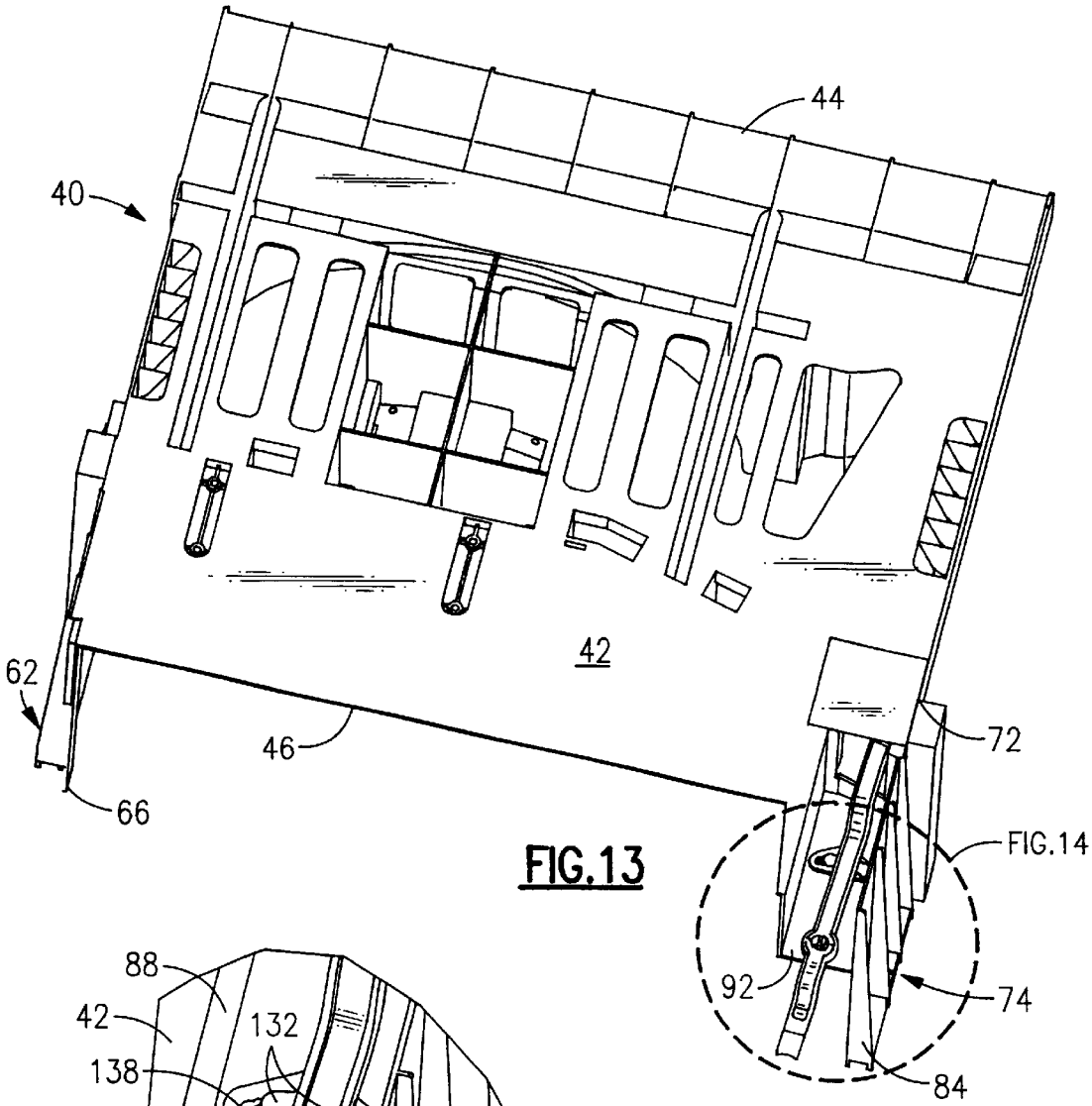
FIG. 13 is a perspective of the large molded component of FIG. 7 from the front top thereof illustrating the actuator in the open position.
Figure 14:
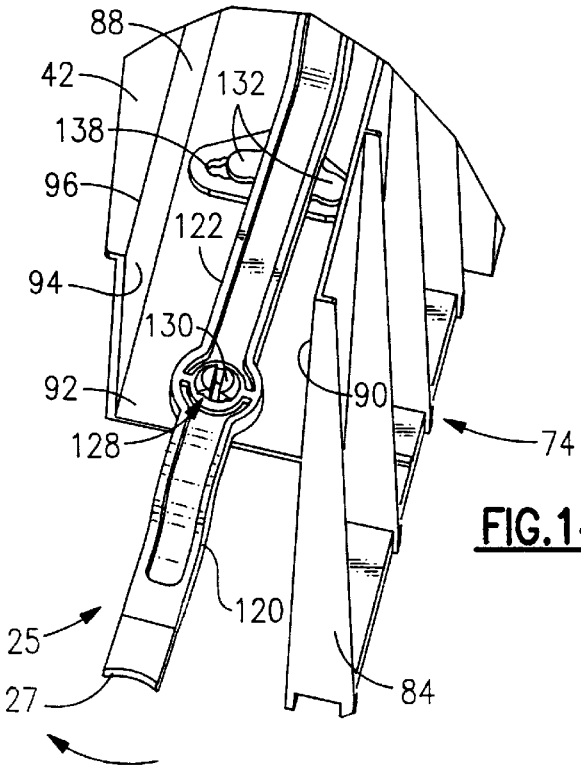
FIG. 14 is an enlarged view of the region identified as FIG. 14 in FIG. 13.
Figure 15:
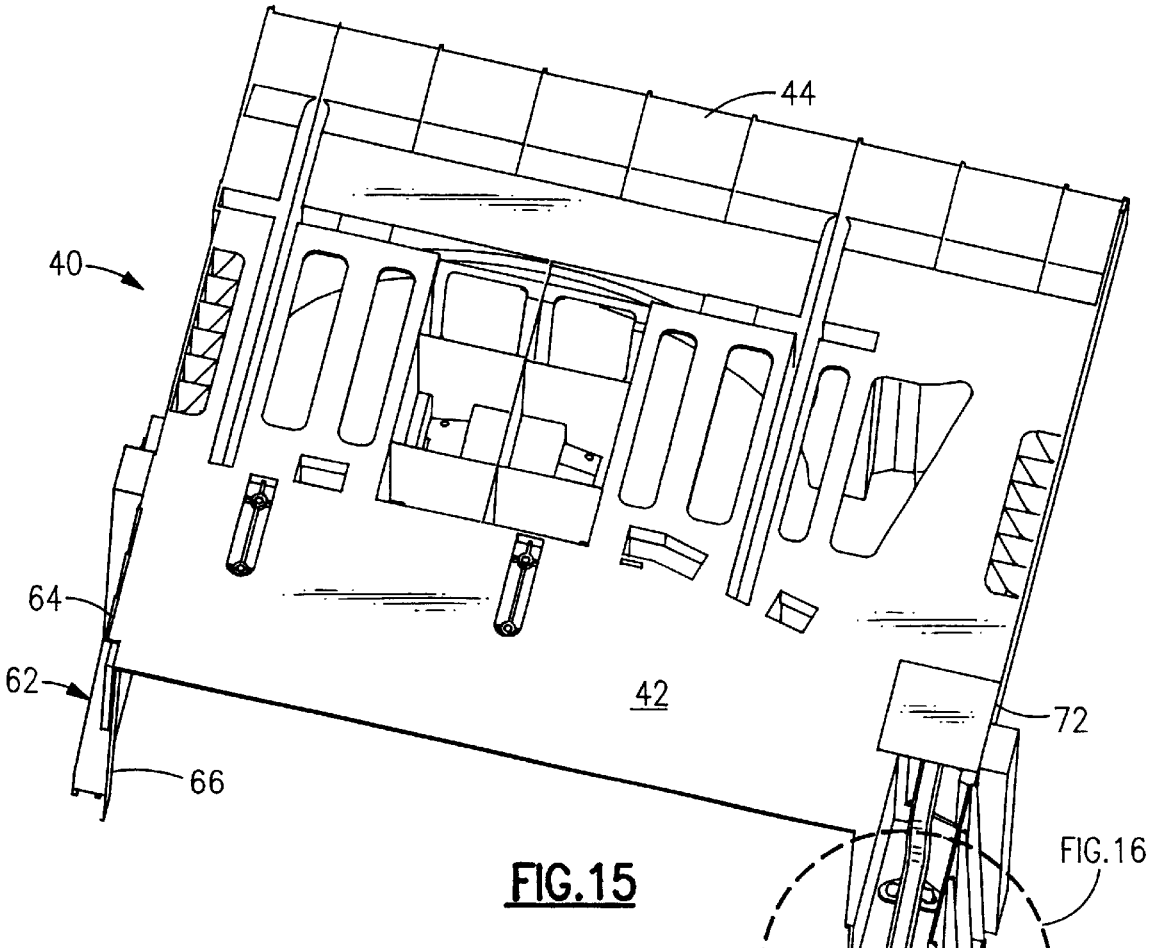
FIG. 15 is a view similar to FIG. 13 with the actuator illustrated in the closed position.
Figure 16:
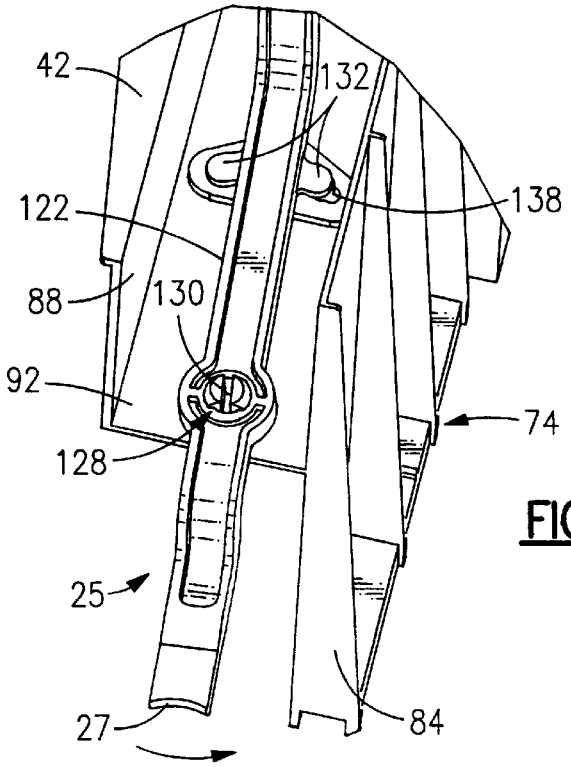
FIG. 16 is an enlarged view of the region identified as FIG. 16 in FIG. 15.

FIGS. 7, 8 and 13–16 show the details of the range of motion of the intermediate section 122 of the actuator. Specifically, FIGS. 13 and 14 illustrate these components as they are engaged when the actuator end 27 is displaced laterally to the left such that the right-hand pin 134 is engaged in the arcuate socket 138 on the right-hand side. Similarly, FIGS. 15 and 16 illustrate these components with the actuator end 27 moved to the right with the left-hand positioning pin 134 in snap-fit engagement with its associated socket 138.

At the inside end of the intermediate section 122, the actuator 25 has a second step section 140, which as seen in FIG. 10, elevates the actuator so that the section 142 extending rearwardly of the second step 140 may through first the rectangular opening 100 and thence through the opening 104 in the partition wall 102. As best seen in FIG. 12, a cube shaped foam insulating element 144 is positioned within the space defined between the walls 100 and 104. The foam cube is provided with a horizontal slot 146 therein, which receives the section 142 of the actuator and allows lateral motion of this section with respect to the cube 144 as the actuator is pivoted about the pivot pin 128. The foam cube serves to prevent flow of air between the indoor and outdoor sections.

Figure 12A:
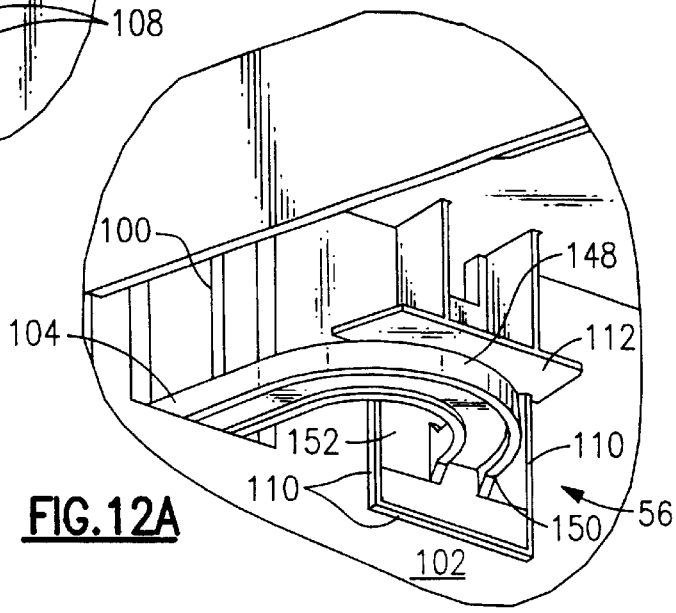
FIG. 12A is a view similar to FIG. 12 with the door closed.

Extending from the linear section 140 of the actuator is a curved section 148. As best seen in FIGS. 11, 12 and 12A, the curved section extends rearwardly into the outdoor section and undergoes a complete change in direction with the end 150 thereof having a rectangular exhaust opening door 152 formed thereon. The door 152 is substantially square in shape and is adapted to fit within the walls 110 and 112 defining the perimeter surrounding the exhaust opening 106 in the wall section 102. As thus configured, the door 152 will be in the position illustrated in FIGS. 11 and 12 with the door spaced from the exhaust opening 106 when the actuator 25 is in the position described above in connection with FIGS. 13 and 14; and, the door 152 will be in confronting sealing relationship with the exhaust opening 106, as illustrated in FIG. 12A, when the actuator 25 is in the position with the end 27 of the actuator displaced to the right, as described above in connection with FIGS. 15 and 16. The snap-fit relationship of the positioning pins 134 with the sockets 138 in the arcuate slot will assure that the door will remain in the selected open or closed position during operation of the air conditioning unit.

What is claimed is:

1. In a room air conditioner of the type having a partition dividing indoor and outdoor sections, the partition having an exhaust opening for exhausting room air into the outdoor section, an improved exhaust and control arrangement comprising:

a scroll structure mounted in the indoor section for directing conditioned air into the space to be cooled, said scroll structure having a rear wall in confronting relation with said partition and having an exhaust opening therein in fluid communication with the indoor section side of said exhaust opening in said partition;

support structure in the indoor section located laterally of and forwardly of said exhaust opening in said partition, said partition having a second opening therethrough positioned adjacent said support structure;

a one-piece exhaust actuation device, said device comprising an elongated actuating arm, said arm having a first end extending forwardly of said support structure, an intermediate section extending in close proximity to said support structure and through said second opening into said outdoor section, and a second end having a curved section configured to extend into said outdoor section in a first direction and to substantially reverse direction with the end of said curved section adjacent to said outdoor section side of said exhaust opening in said partition, said end of said curved section carrying a door thereupon configured to block air flow through said exhaust opening in said partition when in confronting relation therewith;

means on said support structure for pivotally supporting said intermediate section of said actuating arm at a position such that lateral movement of said first end will result in movement of said door selectively between a position in confronting relation with said exhaust opening and a position allowing free exhaust flow through said exhaust opening.

2. The apparatus of claim 1 further including positioned retaining structure formed on said support structure for engaging said intermediate section of said actuating arm and selectively releasably holding said actuator in either said position with said door in confronting relation with said exhaust opening or said position allowing free exhaust flow through said exhaust opening.

3. The apparatus of claim 2 wherein said position retaining structure comprises an arcuate slot formed in said support surface underlying and adjacent to said intermediate arm, said slot having a middle section having a first width and sockets formed at the ends thereof each of said sockets having a diameter less than said width; and wherein said intermediate arm has an arcuate wall formed integrally therewith which is configured to substantially overlie said slot, said arcuate wall having a pair of spaced apart positioning pins extending downwardly therefrom and into said slot, each of said pins being configured to pass from said middle section of said slot to be releasably retained by one of said sockets. said pins and said sockets being positioned such that one of said pins will retain said actuator in said exhaust position and the other pin and socket will retain said actuator in said free flow position.

* * * * *